United States Patent [19]

Rittmaster et al.

[11] 4,326,380

[45] Apr. 27, 1982

[54] HYDRAULIC ENGINE

[76] Inventors: Peter A. Rittmaster, 1420 N. Lake Shore Dr., Apt. 3A, Chicago; John L. Booth, 3905 Tower Dr., Richton Park, both of Ill.

[21] Appl. No.: 110,771

[22] Filed: Jan. 9, 1980

[51] Int. Cl.[3] ..... F02B 71/04; F04B 17/00

[52] U.S. Cl. ..... 60/595; 60/431; 60/433; 417/380; 417/393

[58] Field of Search ..... 60/396, 431, 433, 434, 60/489, 325, 595; 417/396, 317, 380, 393; 91/275; 340/873.31, 873.32; 123/565

[56] References Cited

U.S. PATENT DOCUMENTS

| | | | |
|---|---|---|---|
| 3,114,424 | 12/1963 | Voreaux et al. | 60/443 X |
| 3,649,450 | 3/1972 | Barton | 340/870.31 X |
| 3,935,848 | 2/1976 | Gamell | 123/565 |
| 3,956,973 | 5/1976 | Pomplas | 92/5 R |
| 3,976,401 | 8/1976 | Mountain | 417/343 |
| 3,995,974 | 12/1976 | Herron | 417/380 X |
| 4,040,772 | 8/1977 | Caldarelli | 417/393 X |
| 4,097,198 | 6/1978 | Herron | 417/380 X |
| 4,172,698 | 10/1979 | Hinz et al. | 417/393 |

FOREIGN PATENT DOCUMENTS

| | | | |
|---|---|---|---|
| 482283 | 3/1938 | United Kingdom | 123/565 |

*Primary Examiner*—Irwin C. Cohen

*Attorney, Agent, or Firm*—Dressler, Goldsmith, Shore, Sutker & Milnamow

[57] ABSTRACT

An engine for operating a hydraulic motor. Opposed pistons, joined by a common connecting rod operating between two cylinders and between internal combustion valving and ignition components, are used to drive fluid under pressure through a series of cross-over valves to and from a hydraulic motor. Hydraulic fluid is stored and maintained under pressure within the engine cylinders on the other side of the pistons forming an internal combustion engine. A series of embediments within the common connecting rod actuate a matched set of proximity detectors. The proximity detectors, in turn, time the operation of the engines and the operation of the cross-over valves without mechanical linkages. A hydraulic pump is used to start the engine. A blower is used to mix the fuel and air within the engine and to exhaust combustion gasses. The hydraulic motor drives a flywheel to store energy and to dampen the pulsations resulting from the shifting of the cross-over valves and the reciprocating action of the pistons.

11 Claims, 6 Drawing Figures

HYDRAULIC ENGINE

DESCRIPTION

Technical Field

Apparatus and method for producing a continuous supply of hydraulic fluid under pressure to drive a hydraulic motor. An internal combustion engine driven integral positive displacement pump powering an external hydraulic motor.

BACKGROUND OF THE INVENTION

Although under much criticism during recent years because of polluting emissions, the internal combustion engine nevertheless represents one of the most significant inventions of all times, particularly in terms of its applications as a portable power source. However, the basic cycle has too often been utilized in devices which tend to waste much of the developed energy.

An electrically powered car has been proposed as an alternative to the internal combustion engine power plant per se. Historically, the improvements in gasoline-powered engines and invention of the self-starter eclipsed the future of the electrical vehicle for many years. The principal reason behind the lack of competitiveness of the electric automobile was the limitation of the batteries. A 20-gallon tank of gasoline can provide about 2.4 million BTUs; a lead storage battery weighing about the same as that of a tank of gasoline can provide only some 7,700 BTUs or about 2.25 kilowatt hours. The ratio then, of energy in a tank of gasoline to the energy in the same weight of conventional storage battery is more than 300 to 1. However, an automobile engine can convert only about 1/5 of the energy in the gasoline into driving power, while the electric motor can produce motive effort from nearly all the electricity derived by the battery. Thus, in total energy efficiency—a measure of the amount of energy it takes to move a car a mile—electricity outdistances gasoline. If operating costs per mile are considered there is virtually no comparison: at 1976 prices (and that was before the recent spate of oil price changes) an electric car using ordinary lead acid batteries could be operated for less than 1 cent/mile! The Energy Research and Development Administration (ERDA) predicts that by 1982 electric cars will be capable of cruising 200 miles or more on a single charge at 55 miles per hour. Even with this advantage, however, electric drive has traditionally suffered in performance when compared to that of an internal combustion engine.

The Hybrid engine-electric power plant has been offered as a means for transportation combining the advantages of the internal combustion engine and the electric battery. It has been proposed that a small fossil-fueled engine drive a generator on-board a vehicle which charges the batteries and drives the vehicle's wheels. If this is done, the vehicle can be powered by a relatively small internal combustion engine. In addition, the space devoted to the batteries can be reduced. This space can be filled with fuel having greater energy density. Relative to a pure electric car, a Hybrid vehicle has improved handling performance, and range; this is due to the lower curb weight and higher energy storage capacity. The engine is also relieved of some of the transient demands on its performance. Thus, the engine design can be optimized for low emissions to a greater extent than if it were the sole driving source. A review of some basic principles will dramatize the problems of ordinary spark ignition engines. These problems must be corrected if Hybrid vehicles are to be used efficiently.

The production of power by this type of engine represents a thermodynamic conversion of a portion of the heat energy developed into mechanical energy. The heat energy enters the engine laterally in the form of fuel. Mechanical energy appears as power available to the crankshaft or connecting rod. Unavailable or rejected heat is found in exhaust gasses, cooling water (or air) and mechanical or fluid friction. The conversion of fuel into useful energy takes place about as follows:

Air is brought into the cylinder and, either after, before, or during compression, depending on the cycle, fuel is introduced into the air and mixed with it. Upon ignition of this fuel, the heat developed raises the pressure of the products of combustion, or, at least, maintains the pressure during some motion of the piston. The fact that the piston has, against one face of it, a gas pressure greatly exceeding that of the other, inevitably results in the transmission of energy through the train of mechanism consisting of the moving piston, connecting rod and crankshaft. During the motion of the piston, the gasses of compression expand and are cooled somewhat. It has not been found economical to build an engine sufficiently bulky to expand the gasses until they reach ordinary atmospheric pressure, and consequently there is always considerable heat loss in the exhaust.

From the foregoing it will be understood that the efficiency and useful work performed by an internal combustion engine is largely dependent upon the particular physical structure in which the device is embodied. In addition, the ideal thermodynamic analysis of an internal combustion engine ignores the fact that there are several subsystems, each a thermodynamic cycle in itself, which support the operation of a practical internal combustion engine. Minimizing the energy transferred to or required by these supporting systems and reducing work lost by friction and other non-reversible processes—while an obvious starting point for an improved internal combustion engine—has not heretofore been pursued. Too often, practitioners skilled in the art have been tied to orthodox design concepts. One only has to consider a few of these supporting systems to illuminate the shortcomings of the current approach to engine design.

The lubrication system of an internal combustion engine is a vital and somewhat complex system. An engine operating with a flaming gas in its combustion chamber would not last too long with simple metal to metal contact between the moving parts. One of the most difficult jobs for the lubrication system is lubricating the piston within the cylinder. During a portion of the stroke, the lubricated walls of the cylinder are exposed to incandescent gasses which tend to burn off the film of lubricating oil. An elaborate cooling system is often required to adequately maintain the metal surfaces cool enough to save the lubricating film from destruction. Providing a continuous supply of relatively cool oil to the piston rings and cylinder walls requires a very involved system of internal ports and passageways within the connecting linkage joining the piston and the drive shaft. Interruption of flow through any one of these passages even for a short period of time can quickly lead to piston and cylinder deterioration. Ordinary internal combustion engines typically employ a wrist pin, a connecting rod and a crankshaft to transfer the reciprocating action of the piston to a shaft rotation. Each of these components requires lubrication and the overall assembly must be kept within a fine degree of balance. Friction resulting from poor lubrication and vibration resulting from running gear or crankshaft imbalance wastes energy and eventually leads to engine deterioration and damage. Finally, the cost of fabricating these components is quite expensive because of the internal passageways and precision alignment required. A new engine which is predicated on simplifying lubrication, cooling and balance requirements would not only be less expensive to build and to buy but also less expensive to operate and to maintain.

Since the combustion of fuel in an internal combustion engine requires time, maximum power is typically obtained by "timing" the ignition of the fuel by a sparkplug so as to distribute the combustion process before and after the top dead center position of the piston within the cylinder. Optimum spark advance depends principally upon the air-fuel mixture, the combustion chamber design, turbulence, engine speed, the number of sparkplugs, and sparkplug location. Maximum power air-fuel ratios require the minimum spark advance. For example, low speed engines require about 10 to 20 degrees of spark advance, while high speed automobile engines require 30 to 40 degrees of spark advance. Spark advance in ordinary internal combustion engines is controlled by engine speed and manifold vacuum; increases in both of these independently increase spark advance. The timing train or apparatus used to operate the intake valves and exhaust valves and the sparkplugs is ordinarily a set of mechanical linkages between the shaft of the engine and the rotational or reciprocating components operating the valves and ignition system. Eventually these "mechanical connections" come out of alignment due to deterioration of metal-to-metal contacting parts and linkages. Similarly, in the case of ignition systems using a distributor, the mechanical wearing of the "points" affects the timing of the engine. Recently, so-called "solid state" devices have been marketed that reduce the dependence upon mechanical connections between the engine drive shaft and the device firing the sparkplug. However, it is truly extraordinary for an engine not to use a "linkage" to operate its intake and exhaust valves. Again, this is a reflection of the orthodox thinking that has too often been used in the design of internal combustion engines.

The combustion of fuel in an internal combustion engine is not a continuous affair, but a series of individual explosions, each one requiring a metered amount of fuel to be individually ignited. In most spark-ignition engines, fuel is injected into either a super-charger, the intake manifold, or the combustion chamber. Fuel injection insures a more uniform distribution of fuel over that obtainable through carburetion. Super-charging is a process which increases the amount of fuel-air mixture per cycle of an engine above that of a normally aspirated (carbureted) engine. In addition, fuel injection improves the distribution of fuel and tends to suppress combustion "knock" by increasing the mixture richness. Thus, higher power outputs are obtainable with the use of less volatile fuel. Like the inlet and outlet valves, the fuel injector is ordinarily actuated by a mechanical linkage. When this "mechanical connection" comes out of adjustment, the fuel distribution becomes non-uniform and the power output deteriorates. An automobile propelled by a hybrid engine will have a limited advantage over conventional vehicles if it is dependent upon a fossil-fueled power plant requiring the same periodic engine tune-ups.

Since the combustion of fuel in an internal combustion engine is not continuous, its power is delivered cyclically and in a fashion which fluctuates widely. This power pulsation is ordinarily controlled by using an ordinary flywheel or by overlapping the power pulses through multi-cylindered drive shaft arrangements. In the same sense, a "mechanical connection" is used to set or regulate the timing between the various cylinders to stabilize the output rotation of the engine. Similarly, unless a relatively large number of cylinders is used, each cylinder tends to oppose the other cylinders at least for a portion of its cycle. Thus, in an effort to achieve a balanced shaft output, the conversion of heat energy into rotational or mechanical energy suffers. An engine design providing an output that is relatively constant between spark firings would have improved fuel efficiency.

From the foregoing it is easily understood that an engine not depending upon traditional subsystems (processes which inherently operate at reduced efficiency and require periodic maintenance and tune-up) would of necessity improve the conversion of heat energy into mechanical energy. The elimination of complex mechanical linkages and precision lubrication systems would also improve the efficiency of an internal combustion engine. Fabrication costs would also be significantly reduced. Similarly, a spark-ignition system, the timing of which is essentially independent of direct mechanical connections, would reduce the need for periodic tune-ups and at the same time improve the overall fuel efficiency and smoothness of operation of the engine.

Such an engine when combined with an advanced electric battery to propel an automobile would be a welcomed and long sought-after entry into the marketplace. A hybrid power plant of the type described would go far to eliminate polluting emissions and reduce our country's dependence on foreign oil. In the same sense such an advanced engine could be used in other applications requiring a portable source of power. Marine power plants and home energizing generators are two applications that readily come into mind. Other applications will become apparent from the detailed discussion following.

SUMMARY OF THE INVENTION

The present invention capitalizes on the experience and traditional advantages found in the operation of internal combustion engines to provide a means for powering a fluid motor. When used with an electric automobile propulsion system, the fluid motor would drive an energy storage flywheel and an electric generator to augment and charge the electric battery.

Specifically, two internal combustion engines are positioned oppositely of each other with the two pistons joined by a common non-ferrous connecting rod. Placed along the periphery of the connecting rod and along the axis of the connecting rod are a series of ferrous inserts. A pressurization chamber is formed in the end of each cylinder by a connecting plate. In addition, each plate cooperates with the connecting rod to form a pressure boundary between the interior and exterior of the cylinder while at the same time allowing the connecting rod to reciprocate therethrough. Located around the connecting rod are a set of metal detectors inductively coupled to the inserts on the connecting rod. The detectors are used to "time" the operation of the internal combustion engines. Hydraulic fluid fills the space between the pistons and the connecting plates.

A set of cross-over valves is used to control the flow of fluid between two pressurization chambers. A hydraulic motor is interposed downstream the cross-over valves to convert the flow fluid flowing between the two cylinders into a shaft rotation. The operation of the cross-over valves is controlled by the axial position of the connecting rod relative to the metal detectors. The cross-over valves function in such a manner as to maintain a continuous supply of fluid flowing in one direction so as to maintain the motor shaft in rotation.

A blower is used to supply fresh air to the engines and to scavenge exhaust gasses from the combustion chambers. A fuel injector meters fuel downstream of the blower so as to form a combustible mixture within the combustion chambers of the engines. The operation of the fuel injector is also controlled by the axial position of the connecting rod relative to the metal detectors.

A positive displacement pump is used to position the pistons in their cylinders prior to ignition of the engines (i.e. during start-up). After the engines are set in operation, the positive displacement pump is shut off. A flywheel is joined to the shaft of the hydraulic motor to dampen the pulsations induced by the shifting of the cross-over valves and to store the energy of the pistons between reciprocations. The flywheel may be coupled to an electric generator in the case of an application of the engine to an automobile propulsion system. Other applications will become apparent from the discussion following.

Thus, the reciprocating action of the internal combustion engines is used to directly pump hydraulic fluid to and from the hydraulic motor. In addition, conventional timing linkages are not used to control the operation of the engine. This engine combines and uses the inherent advantages and efficiencies of an internal combustion cycle and at the same time minimizes the energy loss in translating reciprocating motion to a shaft rotation. It is a dramatic and novel approach to the design of spark ignition engines.

DETAILED DESCRIPTION OF THE PREFERRED EMBODIMENTS

Figure 1:
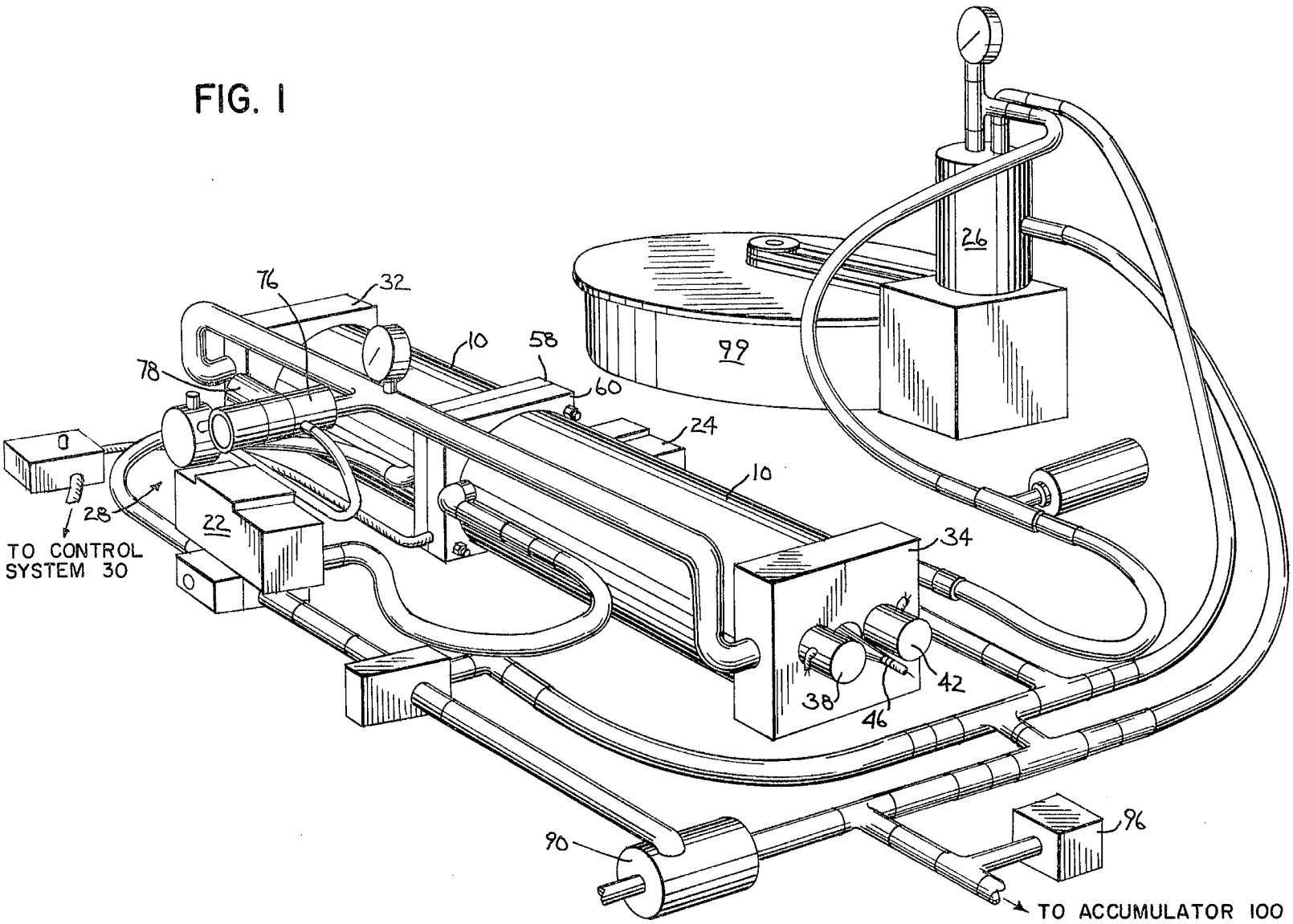
FIG. 1 is a perspective view of the prototype model of the engine that is the subject of the present invention.

While this invention is susceptible of embodiment in many different forms, there are shown in the drawings and will herein be described in detail preferred embodiments of the invention. It being understood, however, that the present disclosure is to be considered as an exemplification of the principles of the invention and is not intended to limit the invention to the embodiment specifically illustrated.

For ease of description, the apparatus of this invention will be described with reference to the operating position shown in the drawings. It will be understood, however, that the apparatus of this invention may be manufactured, stored, transported and used in orientation other than the operating position described. The terms herein are being used in a relative sense.

Figure 2:
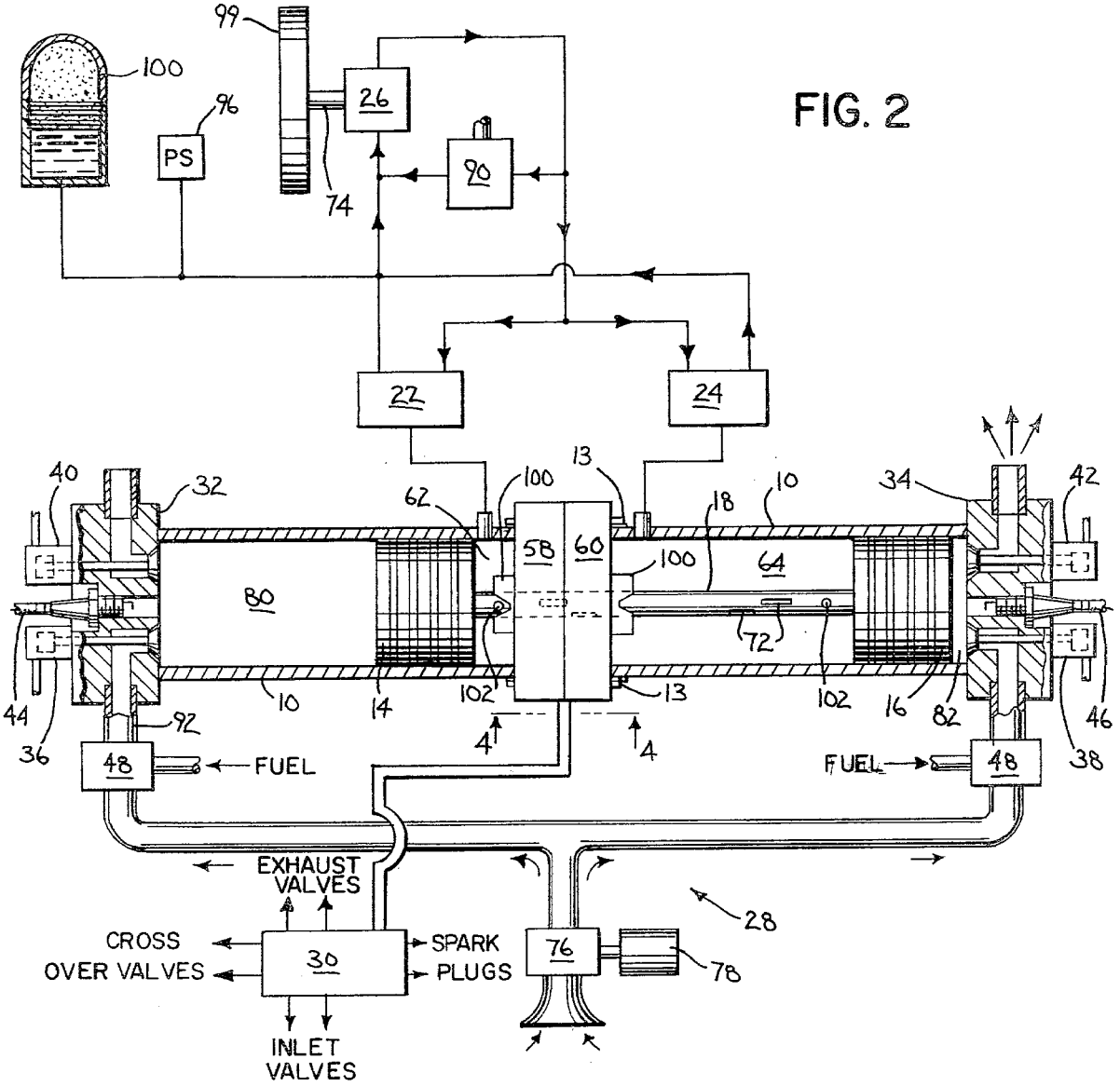
FIG. 2 is a schematic diagram of the engine illustrating the major components and supporting subsystems.

Referring to FIGS. 1 and 2, it is seen that the engine basically includes: two coaxial cylinders 10, 12; two pistons 14, 16 joined by a common connecting rod 18; a center or timing section 20, two cross-over valves 22, 24; a hydraulic motor 26; a fuel and air system 28; and a control system 30. These principal components, parts and systems will now be described in detail.

Each cylinder 10, 12 has a cylinder head 32 and 34 sealing one end; each cylinder head 32, 34 includes intake 36, 38 and exhaust valves 40, 42, a sparkplug 44, 46 and an associated fuel injector 48, 50. The fuel used can be LP gas, hydrogen atomized gasoline or any volatile gas compatible with an air mixture and a spark ignition system. While two coaxial cylinders are illustrated any combustion or arrangement of enclosures permitting the reciprocating action of a piston is permissible. The preferred embodiment is illustrated.

Figure 3:
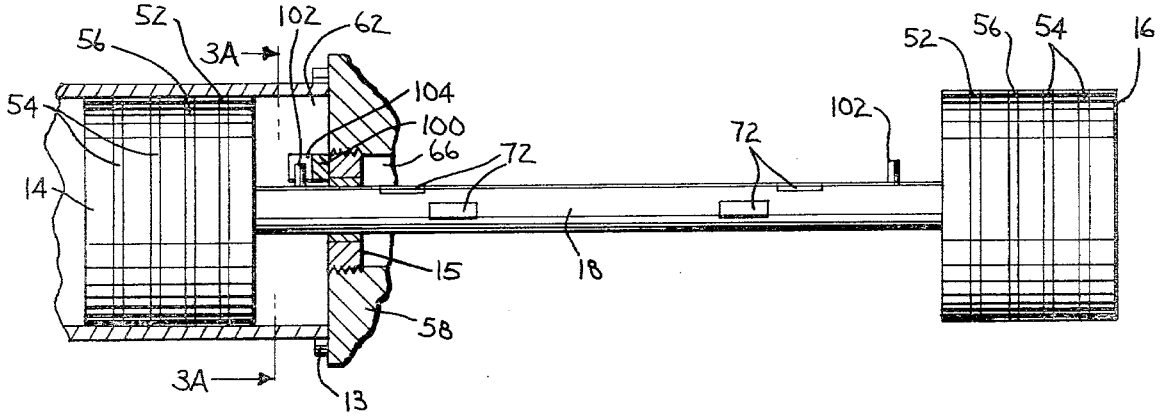
FIG. 3 is an enlarged longitudinal view of the connecting rod and pistons housed within the engine shown in FIG. 2.

Within the two cylinders 10, 12 are two pistons 14, 16 joined by a common connecting rod 18. The pistons (See FIG. 3) are typical of those normally found in internal combustion engines with the addition of an oil seal ring 52 similar in design and function to those usually found in conventional hydraulic cylinders or actuators. In addition to the seal ring 52, the pistons 14, 16 have conventional compression rings 54 and oil distribution rings 56.

The connecting rod 18 is rigidly joined to each of the opposed pistons 14, 16. Unlike ordinary internal combustion engines, a wrist pin is not used to join the connecting rod 18 to the piston. Because of the unique action of the engine (to be described below), there is no need to convert the reciprocating action of the connecting rod to cranking action. Other arrangements may be used to join the two pistons so the inward displacement of one is reflected by the outward or opposite displacement of the other piston.

The two cylinders 10 and 12 are connected to each other by means of tie rods 13 (see FIGS. 1 or 2) and connecting plates 58, 60. Specifically, each cylinder 10, 12 seats on its respective connecting plate 58, 60. O-Rings (not shown) may be used to provide a pressure seal between the center plates 58, 60 and the cylinder walls. When the tie rods 13 are placed in tension a hydraulic seal is formed between the interior of the cylinder and the exterior of the connecting plates.

Since the connecting rod 18 must pass through the connecting plates 58, 60, a hydraulic seal 15 is formed between the center of each connecting plate and the exterior of the connecting rod 18. This seal allows the connecting rod 18 to pass therethrough in a reciprocating fashion while at the same time providing a pressure boundary between the exterior of the two connecting plates and the interior of the cylinders 10, 12. Hydraulic fluid is used to fill the volume 62, 64 defined by the connecting plate 58, 60, the piston 14, 16 and the cylinder 10, 12 walls. This volume will be referred to as a pressurization chamber 62, 64.

Figure 4:
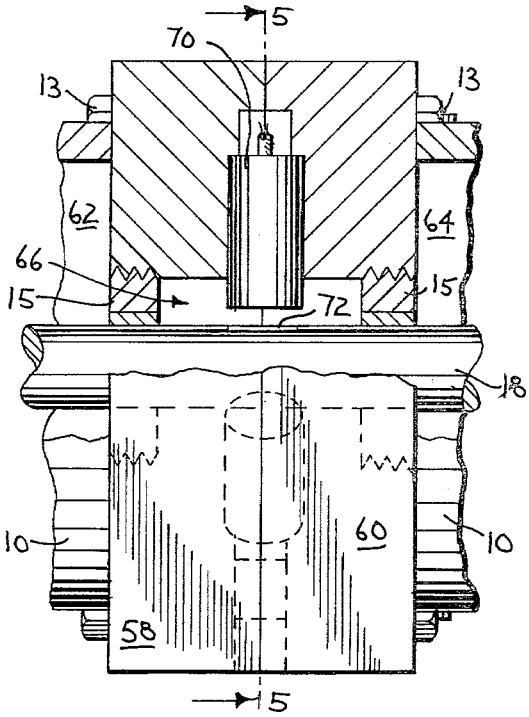
FIG. 4 is a partial or cross-sectional elevational view of the center section of the engine shown in FIG. 2 when viewed along line 4—4 of FIG. 2.
Figure 5:
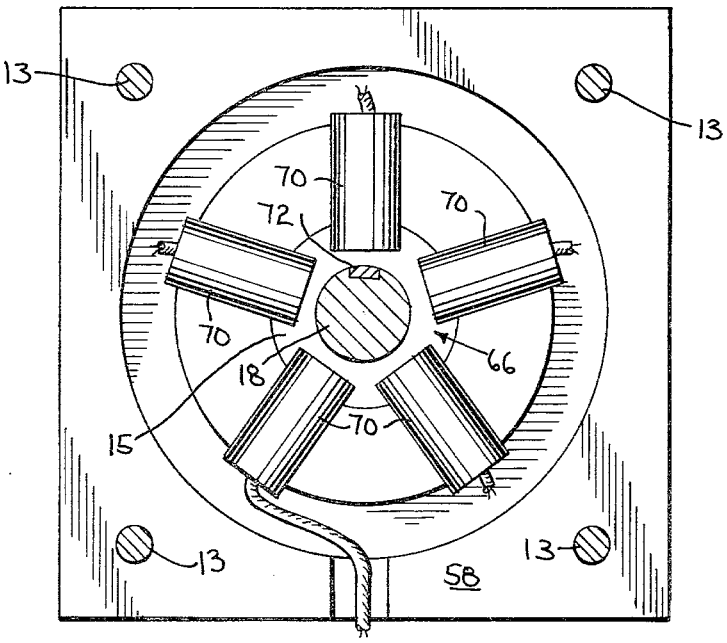
FIG. 5 is a cross-sectional plan view of the center section engine when viewed along line 5—5 of FIG. 4.

The two connecting plates 58, 60 define an annular chamber or space 66 (See FIGS. 4 and 5). Inside of this space 66 are placed a circumferential array of proximity switches or five metal detectors 70. The proximity switches "time" the firing sequence of the engine similar to the manner in which a cam shaft in an ordinary internal combustion engine times the firing cycle. They do this by sensing the axial position of the connecting rod 18.

The connecting rod 18 is fabricated from two different materials. In the case of the prototype engine, the main body of the connecting rod 18 is made of a non-ferrous metal—bronze. Other non-ferrous and non-metallic materials may be used. Modern high strength plastics and advanced anisotropic fiber composite materials may be used. Spaced along the circumference and axially along the length of the connecting rod 18 are a series of ferrous metal inserts 72. The radial position of the inserts is keyed to the angular position of the five proximity switches 70 located between the two connecting plates 58, 60. The length of the insert 72 determines the "dwell" of the proximity switch 70 to which it is keyed. As the piston is fired, the downstroke or stroking of the connecting rod 18 results in these inserts 72 passing under the proximity switches 70 located within the annular chamber 66. The actuation of these switches 70 in turn controls the operation of other engine components. These components are activated or cycled at the proper time in relation to the axial position of the connecting rod 18.

The proximity switches 70 used in the prototype engine are called metal detectors in the sense that they respond to the two different materials forming the connecting rod 18. When one of the ferrous metal inserts embedded into the non-ferrous metal shaft comes under its corresponding proximity switch, the inductive coupling changes so as to "signal" the axial position of connecting rod 18 relative to the annular chamber 66. Other non-contact methods may be used to transmit axial position information between the connecting rod and the fixed portion of the engine. For example, radioactive inserts or cylindrical slits may be produced by direct activation from a neutron source. In that case a series of proximity detectors in the form of shielded radiation detectors would be used. As another example, permanent magnet inserts may be used with a pulse detector switching network used to "count" the embodiments and thus determine instantaneous connecting rod position. In each case the principle is the same: the concept of a connecting rod fabricated from two distinctive materials and a proximity switch capable of distinguishing this material difference as a function of axial position. Other schemes will readily become apparent to one skilled in the art.

Figure 3A:
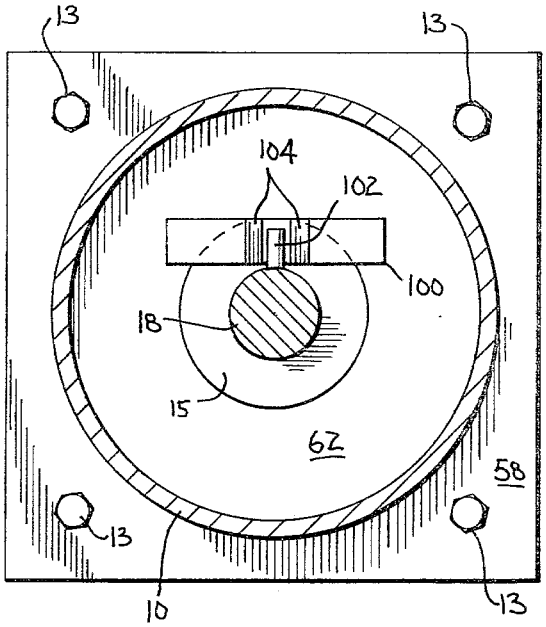
FIG. 3A is a cross-sectional view of the connecting rod and connecting plate when viewed along line 3A—3A of FIG. 3.

To insure that the angular positions of the connecting rod does not change a guide 100 and pin 102 are provided. See FIG. 3A. The guide is positioned within each pressurization chamber 62, 64. If the shaft 18 rotates it is realigned by the pin 102 coming in contact with the shoulders 104 of the guide 100. Due to the relatively slow speed of the engine only a slight angular position change is experienced between engine cycles. Alternatively, non-cylindrical pistons may be used to keep the angular position of the connecting rod fixed. A gap of 7 degrees between the shoulders 104 of the guide has been found satisfactory. The flow of hydraulic oil between the two pistons 14, 16 is controlled by cross-over valves 22, 24. There is one cross-over valve for each cylinder. These valves 22, 24 are externally mounted. They are actuated in response to the proximity switches 70 between the connecting plates 58, 60. These valves 22, 24 are repositioned in response to the stroking of the connecting rod 18. Specifically, the cross-over valves 22, 24 direct hydraulic fluid to or from each of the two pressurization chambers 62, 64. Fluid displaced as a result of the pressurization or power stroke of the engine, is directed by the cross-over valves 22, 24 to an externally positioned hydraulic motor 22. This flow between the cylinders 10, 12 is reversed during the power stroke of the piston for the other cylinder. In other words, the cross-over valves 22, 24 change the direction of flow passing to and from the two pressurization chambers 62, 64 to produce a continuous flow of fluid in one direction to power the externally mounted hydraulic motor 26. The cross-over valves and hydraulic motor are of conventional design.

A master control system 30 employing the five proximity switches 70 as sensors and a matrix of relays and switches directs the operation of the cross-over valves 22, 24, the intake valves 36, 38 and the exhaust valves 40, 42 so as to convert the continuous reciprocating action of the pistons into a shaft 74 rotation on the hydraulic motor 26. These valves are electrically actuated by the control system 30. Electro-hydraulic and electro-pneumatic actuators may be used. Direct electric solenoid positioning is simpler for smaller engines.

It will be understood from the description hereinbefore provided that the engine is neither a two nor a four cycle engine in that the "timing" and actuating of the various intake and exhaust valves and the sparkplug does not follow the usual methodology.

Fuel and air are supplied to the combustion chambers by a small low pressure blower 76 or fan powered by a fractional horsepower electric motor 78. The blower moves a relatively large volume of air into the engine. The air is drawn from the atmosphere through a filter screen (not shown). A blower is needed since the engine operates at an uncommonly low speed—about 6 to 9 seconds between piston firings compared to about 1/30 of a second for conventional engines.

The flow of air through the combustion chambers 80, 82 produces a purging effect or a scavenging effect within the engine. Specifically, the intake 36, 38 and exhaust valves 40, 42 are opened at the same time while air is forced into the combustion chamber by the blower 76. This forces spent combustion gasses out of the combustion chamber 80, 82 and fills the chamber with clean fresh air. The blower 76 is designed to operate continuously when the engine is running. However, once the engine is placed in operation, the blower 76 may be driven by the hydraulic motor 26. The firing speed is controlled by varying the fuel to air ratio. If a throttle valve is used, the amount of fuel drawn into the combustion chamber by the blower is varied. Advancing the engine timing combined with fuel injection control may also be used. The specific technique depends on the application and size of the engine. These speed and load regulation techniques are well known to those skilled in the art.

The starting system for the engine will now be described. All internal combustion engines require some method to initially actuate them to produce the necessary compression of air and fuel for combustion. Ordinarily an electric starter motor is used for this purpose. Here, however, another method is used. Specifically, a small electrically driven hydraulic pump 90 is connected to the hydraulic circuit joined to the hydraulic motor 26. This pump strokes the pistons 14, 16 during start-up. Activation of the start-up pump 90 results in fluid passing through the cross-over valves 22, 24 and into the cylinders 10, 12 so as to force one of the pistons 14, 16 outwardly. This causes initial compression of the gasses within the combustion chamber 80, 82. At the appropriate time, the mixture is ignited causing the engine to go into operation. After the engine is operating the start-up pump 90 is cut out of the piping going to the fluid motor 26.

On initial start-up, both the blower 76 and hydraulic start-up pump 90 are turned on. As the hydraulic pump 90 begins to cycle, the cross-over valves 22, 24 direct hydraulic fluid into one of the pressurization chambers 62, 64 to force the piston 14, 16 therein outwardly so as to compress the gasses within the combustion chamber 80, 82. As the pistons 14, 16 are stroked the ferrous metal inserts 72, embedded in the non-ferrous metal connecting rod 18, activate the appropriate proximity swtiches 70.

During this upstroke or compression stroke of the piston, one of the proximity switches 70 is activated to open the appropriate exhaust valve 40, 42 and the inlet valve 36, 38. This allows the blower 76 to force air into the cylinder's combustion chamber 80, 82 to drive out any stagnant combustion gasses to replace those gasses with fresh air.

As the piston 14, 16 continues to move outwardly, another insert 72 contacts a second proximity switch 70. That switch 70 shuts the exhaust valve 40, 42. Shortly thereafter fuel is forced by the fuel injector 48, 50 into the inlet header 92, 94 downstream of the blower 76. A short time later, the inlet valve 36, 38 is shut. The time each valve is opened is controlled by the length of the appropriate insert 72 on the connecting rod 18. The two inserts controlling the engine's inlet and exhaust valves determine in effect the "dwell time" of the engine.

As the piston continues to move outwardly, air and fuel within the combustion chamber 80, 82 is compressed. Again, when the appropriate connecting rod 18 insert 72 passes the corresponding proximity switch 70, the sparkplug 44, 46 is ignited causing ignition of the combustible mixture within the combustion chamber 80, 82.

Immediately thereafter, on the inward power stroke of the piston 14, 16 the appropriate cross-over value 22, 24 is reversed or shifted. This reverses the flow of hydraulic fluid passing between the two pressurization chambers 62, 64 so as to direct the fluid to flow away from the piston going inwardly and into the opposite pressurization chamber whose piston is going outwardly. This forces hydraulic fluid through the other cross-over valve and into the hydraulic motor 26. As the hydraulic circuit is a closed system, the fluid is forced from the motor and back through the other cross-over valve into the opposite cylinder. An accumulator 100 is used to regulate the volume of the hydraulic circuit. It accounts for volume changes due to leakage and temperature variations. As both pistons are connected together by a common shaft 18, the opposite piston goes outwardly so as to cause compression of the gasses within its associated combustion chamber and the cycle is repeated.

Once the pistons begin firing, a pressure switch 96 going through the hydraulic circuit shuts off the start-up pump 90 since the engine is now operating on its own power. As the first fired piston continues its inward stroke due to the expansion of gasses within the combustion chamber, the opposite piston is moving outwardly so as to force the used or spent combustion gasses out of that combustion chamber. Similarly, at the appropriate time: the outlet valve is shut, fuel is injected, the inlet valve is shut, and the sparkplug activated to force this piston through its power or inward stroke. Again, the inserts 72 within the connecting rod 18 cooperating with the proximity detectors 70 control or time this sequence of operation.

Continuous repetition of these steps causes the engine to cycle continuously. Fluid passes from one pressurization chamber 62, 64 to the other pressurization chamber. Fluid always passes in the same direction through the hydraulic motor 26. This results in a continuous flow of fluid and continual rotation of the motors shaft.

It will be apparent that the hydraulic motor 26 has a pulsating rotation due to the shifting of the cross-over valves 22, 24. Joining the output of the hydraulic motor 26 to a flywheel 99 tends to dampen out these fluctuations and to smooth the overall operation of the hydraulic motor 26. Traditionally ground transportation vehicles, by and large, are powered by ordinary internal combustion engines. In passenger vehicles in particular, the thermal efficiency of the cycle is of the order of 10 to 15 percent. The waste of fossil-fuel distillates and the concomitant problem of air pollution are well documented. An all electric vehicle cannot be built until several major design problems are solved. An electric hybrid vehicle can achieve the same performance objectives with an engine about one fourth the size. Such a vehicle using the engine just described can be operated at maximum efficiency with the flywheel 99 being used for energy storage.

Finally, for purposes of convenience and control the hydraulic motor 26 may be of the hydrostatic variety. Such motors typically have tilt plates to control the stroke of a series of positive displacement cylinders and pistons joined to a ring to provide a shaft rotation. The position of the tilt plate controls the direction of shaft rotation and the speed of the shaft.

While the invention has been described in connection with a preferred embodiment for an automobile application, it will be understood that there are other applications of this unique and innovative engine design. It may be used wherever an efficient portable source of rotational energy is required. Booster pumps for secondary oil wells and long distance pipelines, emergency electrical generators, an augmented supply of power for wind powered generators, and a prime mover for displacement hull boats are only a few of the applications that come into mind. Moreover the simplicity of the design overcomes two of the traditional arguments against abandoning the conventional internal combustion engine—manufacturing costs and time to develop a supporting network of service shops, parts suppliers, and manufacturing facilities. Since the basic invention incorporates spark ignition technology the supporting network is already in existance throughout the world. Since the engine operates at low speed (about 300 times slower than a typical automobile engine) high level component design technology is not required. This lends itself to adoption by new entrants into the marketplace without a large capital investment. Many developing countries can become engine manufacturers without relying extensively on foreign products and skills. Finally, it is estimated that a complete engine overhaul will cost about $200.00 (U.S.) and that maintenance can be extended to 100,000 mile intervals; thus, there is added incentive to adopt the engine to applications that traditionally have been avoided. numerous variations and modifications may be effected without departing from the true spirit and scope of the novel concept of this invention; it should be understood that no limitation with respect to the specific apparatus illustrated herein is intended or should be inferred. It is of course intended to cover by the appended claims all such modifications as fall within the scope of the claims.

I claim:

1. An engine, comprising:

(a) at least one cylinder;

(b) two pistons fitting within said cylinder, each piston having two faces;

(c) rod means for connecting together said pistons, said connecting rod means joining together the first faces of said pistons, each second face of said pistons being directed outwardly towards one end of said cylinder;

(d) two cylinder heads, each head closing off an open end of said cylinder, said second face of said pistons being directed toward the inside of said cylinder heads, said second faces and said cylinder heads defining two combustion chambers;

(e) valve means, associated with each cylinder head, for directing a combustible mixture of fuel and air into said combustion chambers and for exhausting combustion gases from each of said chambers;

(f) ignition means associated with each cylinder head, for igniting said combustible mixture within said combustion chamber;

(g) plate means, interposed along said connecting rod means and cooperating with said cylinder for forming two pressurization chambers, said connecting rod means passing through said plate means, each of said pressurization chambers being defined by the space within said cylinder between said plate means and the first face of the associated piston, each pressurization chamber being joined to the exterior of said cylinder by a flow port in said cylinder wall, said plate means defining a pressure seal between said connecting rod means and the adjacent pressurization chambers, each of said pressurization chambers being filled with hydraulic fluid;

(h) control means for timing and for operating said valve means and said ignition means to reciprocate said pistons within said cylinder in a continuous cycle, said control means including proximity sensor means responding to the axial position of said connecting rod means relative to said plate means;

(i) cross-over means, joining together the fluid within said pressurization chambers via said flow ports in said cylinder wall, for sequentially directing fluid under pressure from one of said pressurization chambers to the other of said pressurization chambers, said cross-over means being operated by said control means responding to the axial position of said connecting rod means relative to said plate means;

(j) motor means, utilizing the fluid passing between said pressurization chambers and through said cross-over means, for driving a shaft in rotation, said cross-over means directing fluid through said motor means to keep said shaft rotating in the same direction, and (k) said connecting rod means being fabricated from a non-ferrous material and having a pluraity of non-contact embedded ferrous inserts angularly positioned along the length of said rod for signalling the position of said connecting rod means to the proximity sensor means of said control means to define the axial position of said connecting rod means relative to said plate means.

2. The engine defined in claim 1, wherein said plate means defines:

an annular chamber, said connecting rod means passing through said chamber.

3. The engine defined in claim 2, wherein said proximity sensor means includes a plurality of metal proximity detectors, said proximity detectors being circumferentially positioned within said annular chamber corresponding to the circumferential position of said ferrous inserts on said connecting rod means, said metal detectors responding electromagnetically to the axial position of said connecting rod means relative to said annular chamber.

4. The engine defined in claim 3, wherein said control means further includes a plurality of switches to sequentially actuate said valve means, said ignition means, and said cross-over means in response to the axial position of said connecting rod means relative to said metal proximity detectors.

5. The engine defined in claim 1, wherein said motor means is joined to a flywheel, said flywheel attenuating the pulsations induced to said motor means by the stroking of said connecting rod means and said pistons and the sequential reversal of flow induced by said cross-over means, said flywheel storing the energy of said pistons.

6. The engine defined in claim 1, further including a positive displacement pump, said pump directing pressurized fluid via said cross-over means to reciprocate said connecting rod means and said pistons to start said engine.

7. The engine defined in claim 1, wherein said connecting rod means is made of bronze and said inserts are made of steel.

8. The engine defined in claim 1, wherein the axial length of said inserts corresponds to the time duration said control means actuates said valve means, said cross-over means, said ignition means, and the dwell time of said engine.

9. The engine defined in claim 1, further including an index means for angularly aligning said connecting rod means relative to said plate means whereby said connecting rod means is rotated at the end of the piston stroke to counter the angular rotation of said connecting rod means during the reciprocation of said pistons.

10. Apparatus for driving a fluid motor including a fluid motor having a shaft, comprising:

(a) a first cylinder open at both ends;

(b) first internal combustion engine means, at one end of said first cylinder, for driving a first piston within said first cylinder in a reciprocating cycle, said first piston having two faces;

(c) first connecting plate, attached to the other end of said first cylinder, said first connecting plate and cylinder cooperating together to form a pressure seal between the interior of said first cylinder and said first connecting plate along the circumference of said other end of said first cylinder, said first connecting plate having a central opening corresponding to the center of said first cylinder, said first piston and first connecting plate within said first cylinder defining a first pressurization chamber;

(d) a second cylinder;

(e) second internal combustion engine means, at one end of said second cylinder, for driving a second pistion within said second cylinder in a reciprocating cycle, said second pistion having two faces;

(f) a second connecting plate, attached to the other end of said second cylinder, said second connecting plate and cylinder cooperating together to form a pressure seal between the interior of said second cylinder and said second connecting plate along the circumference of said other end of said second cylinder, said second connecting plate having a central opening corresponding to the center of said second cylinder, said second piston and second connecting plate within said second cylinder defining a second pressurization chamber;

(g) rod means which is coaxial with said first and second pistons for connecting together said first and said second pistons, said connecting rod means passing through said first and second connecting plates via said central openings in said first and second connecting plates;

(h) means for forming a pressure seal between the periphery of said central opening in each of said connecting plates and said connecting rod means whereby fluid within said pressurization chambers is prevented from leaking along said connecting rod means;

(i) control means, including proximity sensor means, responding to the axial position of said connecting rod means relative to a fixed postion of said apparatus, for actuating said first and second internal combustion engine means to fire them sequentially so as to drive said connecting rod means and said first and second pistons in a continuous reciprocating cycle, said first and second internal combustion engine means being timed to fire such that the power stroke of one of said pistons corresponds to the compression stroke of the other of said pistons, said connecting rod means further comprises a shaft fabricated from a first material, the end points of said shaft being joined to the reciprocating pistons of said first and second internal combustion engine means, and non contact means for signalling the position of said shaft relative to a stationary reference point to said proximity sensor means, said signalling means being joined to said shaft and fabricated from a second material, the axial and angular positions of said signalling means corresponding to portions of the reciprocating cycle of said first and second engine means;

(j) cross-over means, joining together said first and second pressurization chambers and said fluid motor, for valving fluid between said first and second pressurization chambers, said cross-over means being actuated by said control means to sequentially direct fluid from one of said pressurization chambers to the other pressurization chamber upon the power stroke of one of said internal combustion engine means and from the other pressurization chamber to said one of said pressurization chambers upon the power stroke of the other of said internal combustion engine means, said fluid being directed to flow in one direction through said motor to induce rotation of said motor shaft, said first and second cylinders and said connecting rod means being of sufficient length to define an annular space between said first and second connecting plates, and a portion of said control means fitting within said annular space.

11. The apparatus defined in claim 10, wherein: said proximity sensor means includes a plurality of metal proximity detectors, said detectors responding to the ferrous portions of said connecting rod means to indicate the axial position of said shaft relative to a fixed member of said apparatus.

* * * * *